US010131179B2

(12) United States Patent
Mess

(10) Patent No.: US 10,131,179 B2
(45) Date of Patent: Nov. 20, 2018

(54) WRITING UTENSIL PUZZLE KIT

(71) Applicant: William Mess, Ocala, CA (US)

(72) Inventor: William Mess, Ocala, CA (US)

( * ) Notice: Subject to any disclaimer, the term of this patent is extended or adjusted under 35 U.S.C. 154(b) by 9 days.

(21) Appl. No.: 15/589,074

(22) Filed: May 8, 2017

(65) Prior Publication Data

US 2017/0320352 A1 Nov. 9, 2017

Related U.S. Application Data

(60) Provisional application No. 62/333,358, filed on May 9, 2016.

(51) Int. Cl.

| | |
|---|---|
| ***B43K 29/00*** | (2006.01) |
| ***B43K 7/00*** | (2006.01) |
| ***A63F 9/06*** | (2006.01) |
| *A63F 9/00* | (2006.01) |
| *B43K 29/007* | (2006.01) |

(52) U.S. Cl.

CPC ..... *B43K 29/00* (2013.01); *A63F 9/0666* (2013.01); *B43K 7/005* (2013.01); *A63F 2009/0018* (2013.01); *B43K 29/007* (2013.01)

(58) Field of Classification Search

CPC .... B43K 29/00; B43K 29/007; B43K 23/008; B43K 23/02; A63F 9/001; A63F 2009/0018

USPC ..... 401/195

See application file for complete search history.

(56) References Cited

U.S. PATENT DOCUMENTS

| | | | |
|---|---|---|---|
| 6,158,914 | A | 12/2000 | Junkins |
| 6,612,766 | B2 | 9/2003 | Collins |
| 7,275,744 | B1 | 10/2007 | Kuo |
| 2001/0001631 | A1 | 5/2001 | Platts et al. |
| 2015/0269853 | A1 | 9/2015 | Raad |

*Primary Examiner* — David Walczak
*Assistant Examiner* — Joshua Wiljanen
(74) *Attorney, Agent, or Firm* — Global Intellectual Property Agency, LLC; Daniel Boudwin

(57) ABSTRACT

A writing utensil puzzle kit for amusement and advertising purposes. The writing utensil puzzle kit includes a shaft, a writing member affixed to the shaft, a front housing piece securable to the writing member, a rear housing piece having a front end and rear end, wherein the rear end is securable to an end cap. A plurality of central housing pieces having a central channel that can receive the shaft, wherein each of the central housing pieces are securable to one another in a particular order via a threaded protrusion disposed on a front end thereof that can removably secure to a recessed channel disposed on a back end of an adjacent central housing piece. A gripping member is mountable to the housing piece. In an additional embodiment, the gripping member includes a plurality of interlocking gripping members with indicia thereon for indicating the particular order of connection thereof.

13 Claims, 3 Drawing Sheets

WRITING UTENSIL PUZZLE KIT

CROSS REFERENCE TO RELATED APPLICATION

This application claims the benefit of U.S. Provisional Application No. 62/333,358 filed on May 9, 2016. The above identified patent application is herein incorporated by reference in its entirety to provide continuity of disclosure.

BACKGROUND OF THE INVENTION

The present invention relates to puzzle kits for pens. More specifically, the present invention provides a writing utensil puzzle kit used for amusement and advertising purposes.

Writing utensils, such as pens and pencils, have been used as promotional items for businesses for many years. Typically, advertisers will print their logos on the outer portion of a pen or pencil and hand these out at tradeshows, promotional events, or directly to potential clients. The idea being that their brand name will be recognized by the potential client while using the writing utensil. In theory, the more time a person uses a promotional pen or pencil labeled with an advertisement, the more time that person will potentially think about the promoted business. While pens and pencils are often used for advertising purposes, puzzle pens typically are not.

Devices have been disclosed in the known art that relate to puzzle pens. These include devices that have been patented and published in patent application publications. These devices generally relate to puzzle pens such as: a puzzle pen, a combination writing instrument and toy, and a writing instrument adorned with beads.

These known art devices have several known drawbacks. Many of these devices, although termed as puzzle pens, are merely an arrangement of colored pieces that are interchangeable thereon the pen. These puzzle pens lack interlocking jigsaw pieces that truly make them a puzzle. Without the interlocking jigsaw pieces, the thought and time necessary to put the puzzle pen together is minimal, which leads to less enjoyment when using the pen. Further, some writing instruments are only described as puzzle-like, wherein the main feature is to adorn the writing instrument with a variety of shaped beads or symbols allowing the user to create an aesthetically pleasing pen. Lastly, some of the known devices are utilized for entertainment purposes only, and fail to include indicia on the exterior of the pen for indicating the correct order the interlocking jigsaw pieces are to be connected to one another.

In light of the devices disclosed in the known art, it is submitted that the present invention substantially diverges in design elements from the known art and consequently it is clear that there is a need in the art for an improvement to existing puzzle pen devices. In this regard the instant invention substantially fulfills these needs.

SUMMARY OF THE INVENTION

In view of the foregoing disadvantages inherent in the known types of puzzle pens now present in the known art, the present invention provides a new writing utensil puzzle kit wherein the same can be utilized for providing convenience for the user when writing, advertising, or passing time.

It is therefore an object of the present invention to provide a new and improved writing utensil puzzle kit device that has all of the advantages of the known art and none of the disadvantages.

It is another object of the present invention to provide a writing utensil puzzle kit comprising a shaft having a first end and second end, a writing member having an open end comprising a threaded channel, wherein the threaded channel is affixed to the first end of the shaft, a front housing piece having a front end and a back end, wherein the front end is securable to the open end of the writing member, a rear housing piece having a front end and rear end, wherein the rear end is securable to an end cap, a plurality of central housing pieces having a threaded outer surface and a central channel configured to receive the shaft, a front end and back end, wherein the front end includes a threaded protrusion and the back end includes a recessed channel configured to receive a threaded protrusion, and a gripping member, wherein the gripping member is mountable to the housing piece.

Another object of the present invention is to provide a writing utensil puzzle kit, wherein the front housing piece, the plurality of central housing pieces, and the rear housing piece are configured to be stacked such that the front end of each housing piece following the front housing piece rests flush against the back end of an adjacent piece, when placed in the proper order.

Yet another object of the present invention is to provide a writing utensil puzzle kit, wherein the gripping member is configured as a sport ball having a threaded interior cavity, whereby the threaded interior cavity is securable to the threaded outer surface of the plurality of central housing pieces.

Yet another object of the present invention is to provide a writing utensil puzzle kit, in an alternative embodiment, wherein a plurality of gripping members are interlocking, each gripping member of the plurality of gripping members having an upper perimeter and a lower perimeter, wherein each of the plurality of gripping members include a protrusion and a slot such that adjacent gripping members interlock to one another via a press fit connection between each protrusion and slot.

Yet another object of the present invention is to provide a writing utensil puzzle kit, in an alternative embodiment, wherein the plurality of gripping members include indicia thereon, wherein the indicia is configured to indicate that the slots and protrusions of adjacent gripping members are aligned.

Another object of the present invention is to provide a writing utensil puzzle kit that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
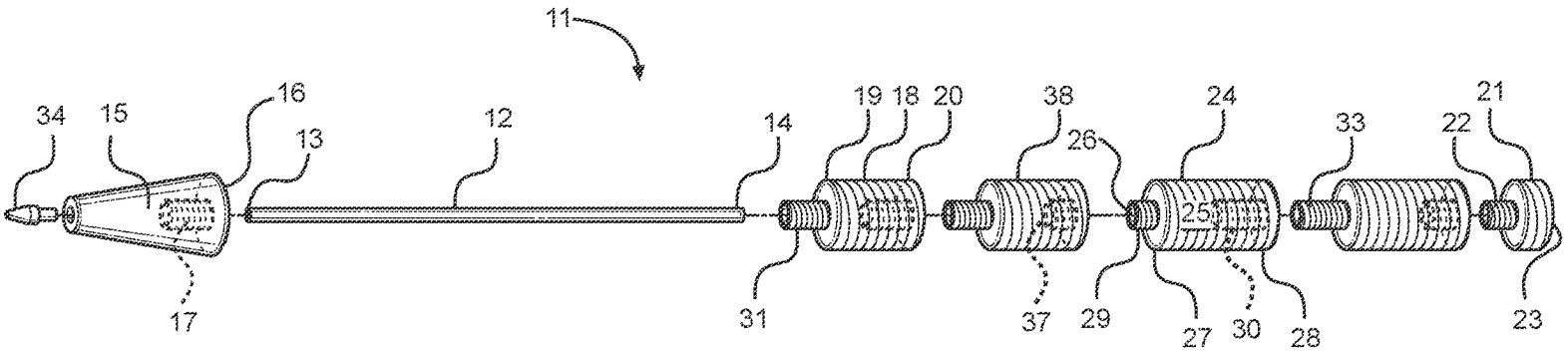
FIG. 1 shows an exploded view of unassembled housing pieces of the writing utensil puzzle kit.

Reference is made herein to the attached drawings. Like reference numerals are used throughout the drawings to depict like or similar elements of the writing utensil puzzle kit. For the purposes of presenting a brief and clear description of the present invention, the preferred embodiment will be discussed as used for amusement and advertising purposes. The figures are intended for representative purposes only and should not be considered to be limiting in any respect.

Figure 2:
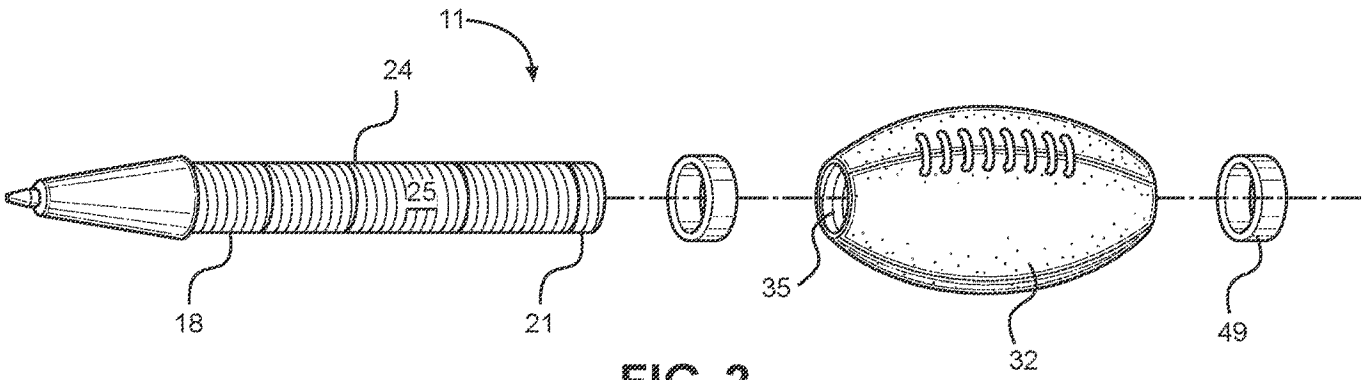
FIG. 2 shows an exploded view of a gripping member and spacers of the writing utensil puzzle kit, wherein the gripping member and spacers are mountable to stacked housing pieces.

Referring now to FIG. 1 and FIG. 2, there is shown an exploded view of unassembled housing pieces of the writing utensil puzzle kit and an exploded view of a gripping member and spacers, wherein the gripping member and spacers are mountable to stacked housing pieces, respectively. The writing utensil puzzle kit 11 comprises a shaft 12 having a first end 13 and second end 14, a writing member 15 having an open end 16 comprising a threaded channel 17, wherein the threaded channel 17 is affixed to the first end 13 of the shaft 12. The kit 11 further comprises a front housing piece 18 having a front end 19 and a back end 20, wherein the front end 19 is securable to the open end 16 of the writing member 15, and a rear housing piece 21 having a front end 22 and rear end 23, wherein the rear end 23 is securable to an end cap.

In the illustrated embodiment, the front end 19 of the front housing piece 18 comprises a threaded protrusion 31 with a length equal to the depth of the threaded channel 17 of the writing member 15, whereby the threaded protrusion 31 is removably securable to the threaded channel 17 of the writing member 15. In the illustrated embodiment, the first end 13 of the shaft 12 fastens the writing member 15 in place by engaging the writing member 15 between the first end 13 of the shaft 12 and a ball point pen tip 34. This allows the shaft 12 to remain in place while the threaded protrusion 31 of the front housing piece 18 is removably secured to the threaded channel 17 of the writing member 15.

In the illustrated embodiment, the writing member 15 provides a means of writing by utilizing the ball point pen tip 34 and ink stored within the shaft 12, but this is not meant to be limiting. In alternative embodiments, other writing means, such as graphite or a stylus, may be used.

Further, the kit 11 contains a plurality of central housing pieces 24 having a threaded outer surface 25 and a central channel 26 configured to receive the shaft 12, a front end 27 and back end 28, wherein the front end 27 includes a threaded protrusion 29 and the back end 28 includes a recessed channel 30 configured to receive an adjacent threaded protrusion 33.

The front housing piece 18, the plurality of central housing pieces 24, and the rear housing piece 21 are configured to be stacked, as illustrated in FIG. 2, such that a front end of each piece rests flush against the back end of an adjacent piece. The recessed channel 37 of a first central housing piece 38 comprises a same length of a length of a threaded protrusion 29 extending from an adjacent second central housing piece 24 such that the front end of the adjacent central housing piece 24 rests flush against the back end of the first central housing piece 38.

In the illustrated embodiment, only three central housing pieces 24 are shown. Alternative embodiments may have more central housing pieces 24 with varying length protrusions 29 and recessed channels 30. As further central housing pieces 24 are added, each consecutive central housing piece is meant to have a different length threaded protrusion, whereby the recessed channel of the preceding central housing piece receives a threaded protrusion of a successive central housing piece. Each preceding central housing piece has a recessed channel depth equal to the length of a threaded protrusion of a successive housing piece such that the central housing pieces are configured to be sequentially ordered by fit. In the illustrated embodiment, each central housing piece 24, the front housing piece 18, and the rear housing piece 21 are configured to connect in a single order, such that none of the housing pieces are interchangeable with one another.

In the illustrated embodiment, the housing pieces 18, 21, 24 of the writing utensil puzzle kit 11 are designed to be a puzzle, whereby the user puts the housing pieces 18, 21, 24 in the correct sequence. If the housing pieces are placed in the correct sequence, the front end 27 of a central housing piece 24 will rest flush against the back end 28 of an adjacent central housing piece 24, such that the central housing pieces 24 are void of gaps therebetween. In other embodiments, if the housing pieces are placed in the correct sequence, the front end 19 of the front housing piece 18 will rest flush against the perimeter of the open end 16 of the writing member 15 and the front end 22 of the rear housing piece 21 will rest flush against a rear end 28 of an adjacent central housing piece 24.

In the illustrated embodiment, the writing utensil puzzle kit 11 further comprises a gripping member 32, wherein the gripping member 32 is mountable to the assembled central housing pieces 24. In the illustrated embodiment, the gripping member 32 is a sport ball, such as a football, baseball, soccer ball, basketball, tennis ball, and the like. The gripping member 32 includes a threaded interior cavity 35, thereby allowing the gripping member 32 to securely attach to the threaded outer surface 25 of the central housing pieces 24. Further, the kit 11 comprises a plurality of spacers 49 that are mountable to the central housing pieces 24. These spacers 49 are used to separate and maintain multiple gripping members 32 in various positions on the central housing pieces 24. The spacers 49 can be of any size or width.

Figure 3:
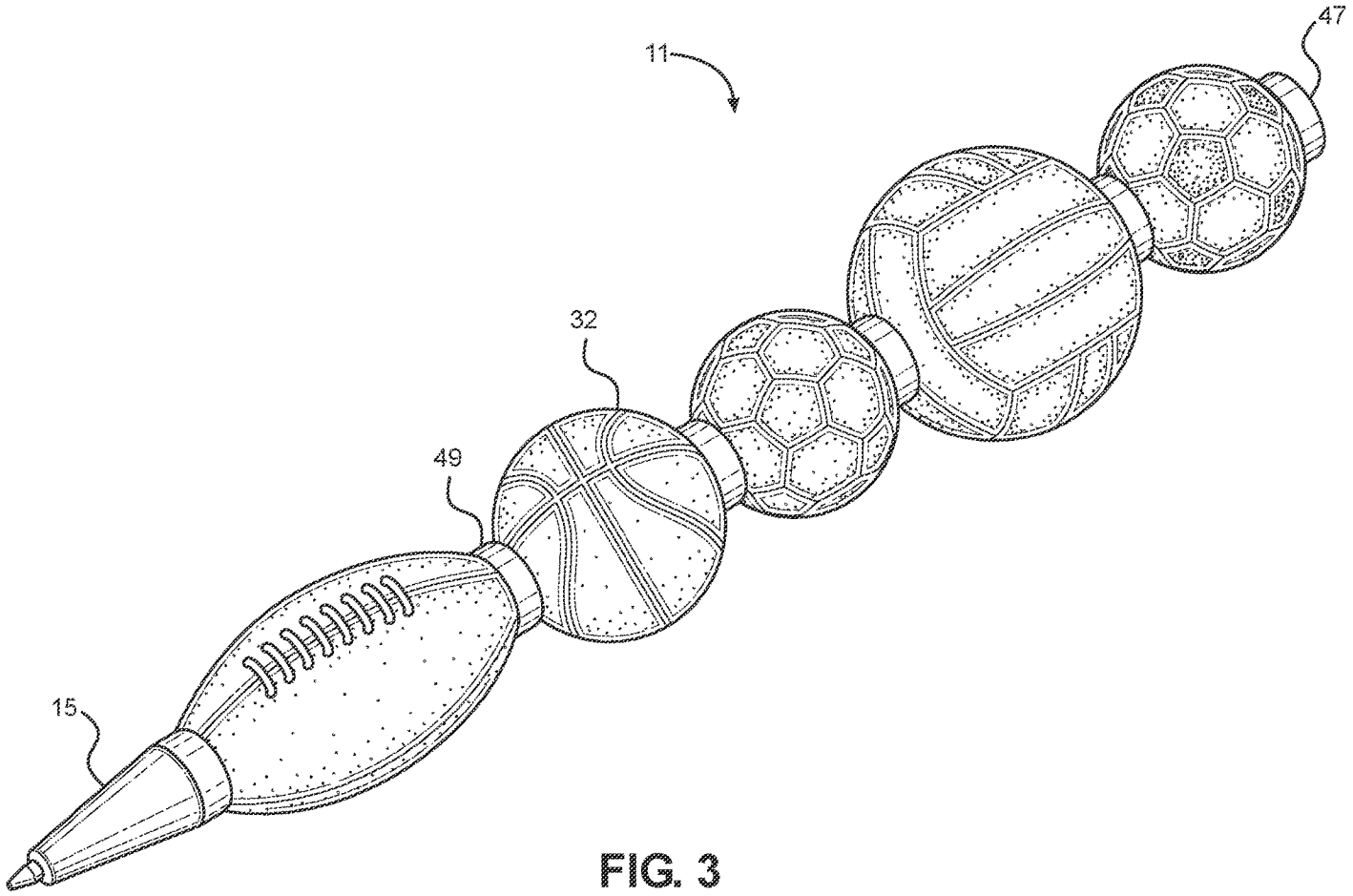
FIG. 3 shows a perspective view of the assembled writing utensil puzzle kit, wherein gripping members are sport balls.

Referring now to FIG. 3, there is shown a perspective view of the assembled writing utensil puzzle kit, wherein gripping members are sport balls. In the illustrated embodiment, the gripping members 32 are sport balls. The gripping members 32 are separated by spacers 49 and securely attached to the housing pieces of the writing utensil puzzle kit 11. The gripping members 32 and spacers 49 are retained in place by utilizing an end cap 47 that is securely attached to the rear housing piece and the writing member 15. In alternative embodiments, the gripping members 32 may comprise other shapes, and are not limited to sport balls. Additionally, the interior cavity may be smooth, making it slidably mountable to the housing pieces. The spacers 49 are also configured to be slidably mountable, but may be mountable by other means, such as having a threaded interior.

Figure 4:
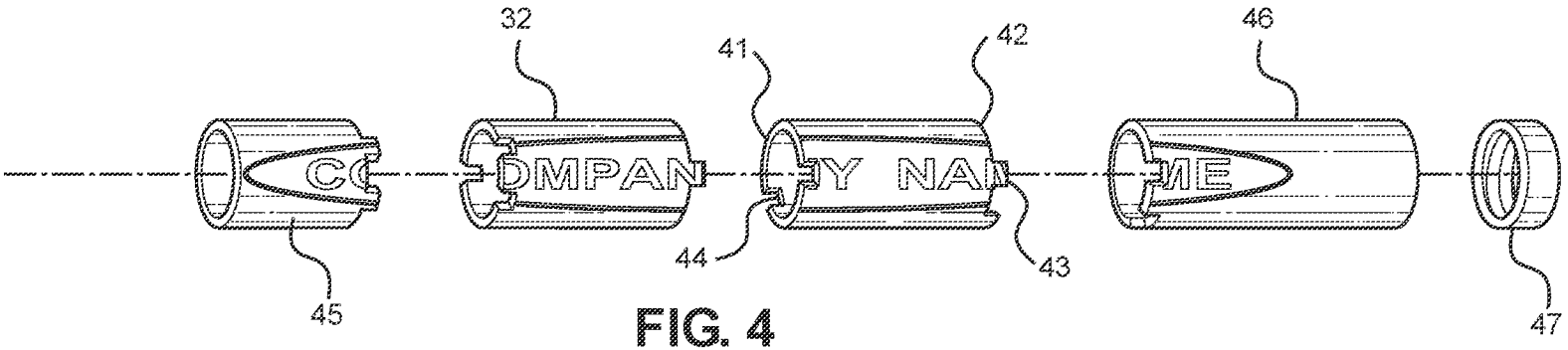
FIG. 4 shows an exploded view of an alternative embodiment of gripping members of the writing utensil puzzle kit, wherein the gripping members are configured to be interlocking.
Figure 5:
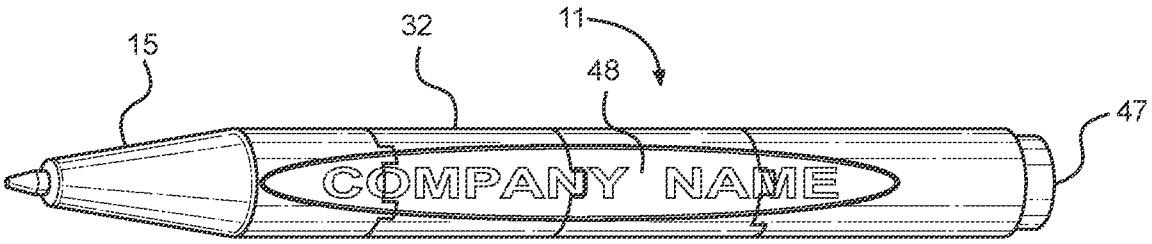
FIG. 5 shows a perspective view of an alternative embodiment of the gripping members for the writing utensil puzzle kit, wherein indicia indicate the gripping members are interlocked in the correct position.

Referring now to FIGS. 4 and 5, there is shown an exploded view of an alternative embodiment of gripping members of the writing utensil puzzle kit, wherein the gripping members are configured to be interlocking and a perspective view of the gripping members, wherein indicia indicates the gripping members are interlocked in the correct position, respectively. In this alternative embodiment, the plurality of gripping members 32 are interlocking with one another, wherein each gripping member 32 has an upper perimeter 42 and a lower perimeter 41. Further, each of the plurality of gripping members 32 include a protrusion 43 and a slot 44, such that adjacent gripping members interlock to one another via a press fit connection between each protrusion 43 and slot 44.

In the illustrated embodiment, a first gripping member 45 of the plurality of gripping members 32 includes a lower perimeter 41 adapted to rest flush against the writing member 15 and an upper perimeter 42 comprising a same number of slots 44 as protrusions 43 of a lower perimeter 41 of a second, adjacent gripping member. The last gripping member 46 of the plurality of gripping members 32 includes a lower perimeter 41 comprising a same number of slots 44 as protrusions 43 of an upper perimeter 42 of a preceding gripping member and an upper perimeter 42 adapted to rest flush against the end cap 47. When assembled in the correct sequence, the gripping members rest flush against each other such that all of the protrusions align within a respective slot and are retained in place between the writing member 15 and the end cap 47. In the illustrated embodiment, the slots 44 and protrusions 43 comprise a rectangular cross section; however, in alternate embodiments, the slots 44 and protrusions 43 can comprise any shaped cross section as long as the shape of the cross section of a protrusion 43 corresponds to the cross sectional shape of a respective slot when aligned in the correct sequence.

Furthermore, the illustrated embodiment includes gripping members 32 with indicia 48 thereon. The indicia 48 is configured to indicate that the slots 44 and protrusions 43 of adjacent gripping members are aligned. In the illustrated embodiment, the indicia 48 disposed on the gripping members 32 when completely assembled is a shape or and a word. If the gripping members 32 are not in the correct sequence, the all of the protrusions 43 will not be aligned with slots 44 and the indicia 48 will not form a complete shape or word. In addition to showing the gripping members 32 are aligned and the puzzle is completed correctly, the indicia 48 also allows the pen to be used for advertising purposes.

The gripping members 32 in the illustrated embodiment lack a threaded interior cavity, allowing them to be rotatable around the central housing pieces. This provides the user the capability to freely spin the gripping member around the housing of the pen, thereby relieving stress and allowing the user to focus. In some embodiments, the writing utensil puzzle kit 11 is completely disassembled such that no individual piece is connected to another.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A writing utensil puzzle kit comprising:

a shaft having a first end and second end;

a writing member having an open end affixed to the first end of the shaft;

a front housing piece having a front end and a back end, wherein the front end is securable to the open end of the writing member;

a rear housing piece having a front end and rear end, wherein the rear end is securable to an end cap;

a plurality of central housing pieces having a front end, a back end, a threaded outer surface, and a central channel configured to receive the shaft;

the front end of each of the plurality of central housing pieces includes a threaded protrusion and the back end of each of the plurality of central housing pieces includes a recessed channel configured to receive a threaded protrusion;

a gripping member, wherein the gripping member is mountable to the plurality of central housing pieces.

2. The writing utensil puzzle kit of claim 1, wherein the front end of the front housing piece comprises a threaded protrusion with a length equal to the depth of a threaded channel of the writing member, whereby the threaded protrusion of the front housing piece is removably secure to the threaded channel of the writing member.

3. The writing utensil puzzle kit of claim 1, wherein the front housing piece, the plurality of central housing pieces, and the rear housing piece are configured to be stacked such that the front end of each of the plurality of central housing pieces following the front housing piece rests flush against the back end of an adjacent central housing piece and the rear housing piece rests flush against a last central housing piece.

4. The writing utensil puzzle kit of claim 1, wherein the recessed channel of a first central housing piece comprises a same length of a length of a threaded protrusion extending from an adjacent central housing piece such that the front end of the adjacent central housing piece rests flush against the back end of the first central housing piece, whereby the recessed channel of a preceding housing piece of the plurality of housing pieces receives a threaded protrusion of a successive housing piece of the plurality of housing pieces, wherein each preceding housing piece has a recessed channel depth and each successive housing piece has a threaded protrusion length configured to be sequentially ordered by fit whereby the front end of each housing piece rests flush against the back end of each adjacent central housing piece of the plurality of central housing pieces when configured in the correct order.

5. The writing utensil puzzle kit of claim 4, wherein the length of the protrusion of each of the plurality of central housing pieces is different.

6. The writing utensil puzzle kit of claim 1, wherein the gripping member is configured as a sport ball having a threaded interior cavity, whereby the threaded interior cavity is securable to the threaded outer surface of the plurality of central housing pieces.

7. The writing utensil puzzle kit of claim 1, further comprising, a spacer, wherein the spacer is mountable to a housing piece.

8. The writing utensil puzzle kit of claim 1, wherein the gripping member is a plurality of gripping members, wherein each of the plurality of gripping members comprise an upper perimeter and a lower perimeter, wherein each of the lower perimeter comprises a slot and the upper perimeter comprises a protrusion such that adjacent gripping members interlock to one another via a press fit connection between each protrusion and slot.

9. The writing utensil puzzle kit of claim 8, wherein a first gripping member of the plurality of gripping members includes a lower perimeter adapted to rest flush against the writing member and an upper perimeter comprising a same number of slots as protrusions of a lower perimeter of a second gripping member.

10. The writing utensil puzzle kit of claim 9, wherein a last gripping member of the plurality of gripping members includes a lower perimeter comprising a same number of slots as protrusions of an upper perimeter of a preceding gripping member and an upper perimeter adapted to rest flush against the end cap.

11. The writing utensil puzzle kit of claim 10, wherein the plurality of gripping members include indicia thereon, wherein the indicia is configured to indicate that the slots and protrusions of adjacent gripping members are aligned.

12. The writing utensil puzzle kit of claim 1, wherein the shaft is configured to hold ink.

13. The writing utensil puzzle kit of claim 1, wherein the shaft is configured to hold graphite.

* * * * *